US007818836B2

(12) United States Patent
Stinson

(10) Patent No.: US 7,818,836 B2
(45) Date of Patent: Oct. 26, 2010

(54) DEVICE FOR POSITIONING BEDRIDDEN INDIVIDUALS

(76) Inventor: Heather Stinson, 255 River Dr., East Palatka, FL (US) 32131

( * ) Notice: Subject to any disclaimer, the term of this patent is extended or adjusted under 35 U.S.C. 154(b) by 0 days.

(21) Appl. No.: 12/009,767

(22) Filed: Jan. 22, 2008

(65) Prior Publication Data

US 2009/0183309 A1 Jul. 23, 2009

(51) Int. Cl.
*A47G 9/00* (2006.01)
*A61G 7/10* (2006.01)

(52) U.S. Cl. ..... 5/487; 5/488; 5/81.1 T

(58) Field of Classification Search ..... 5/81.1 HS, 5/81.1 T, 81.1 R, 487, 488
See application file for complete search history.

(56) References Cited

U.S. PATENT DOCUMENTS 3,315,676 A * 4/1967 Cooper ..... 604/366
3,458,878 A 8/1969 Combs
3,884,225 A 5/1975 Witter
4,180,879 A 1/1980 Mann
4,253,701 A * 3/1981 Kifferstein ..... 297/220
4,536,903 A 8/1985 Parker
4,675,925 A 6/1987 Littleton
4,872,226 A 10/1989 Lonardo
4,908,889 A 3/1990 Lonardo
5,005,231 A * 4/1991 Lonardo ..... 5/81.1 T
6,073,279 A 6/2000 Skaler
6,560,793 B2 * 5/2003 Walker ..... 5/81.1 T
2002/0029417 A1 * 3/2002 Walker ..... 5/81.1 R
2008/0216231 A1 * 9/2008 Lambarth et al. ..... 5/81.1 HS

* cited by examiner

*Primary Examiner*—Shane Bomar
*Assistant Examiner*—Gilbert Y Lee
(74) *Attorney, Agent, or Firm*—Thomas C. Saitta

(57) ABSTRACT

A bedridden individual positioning device, the device having a pad member with at least two sets of turning members attached on its sides and at least one line of perforations or the like extending laterally across the pad member such that the lower portion of the pad member can be separated from the remainder portion if the lower portion becomes soiled.

18 Claims, 3 Drawing Sheets

FIG. 4
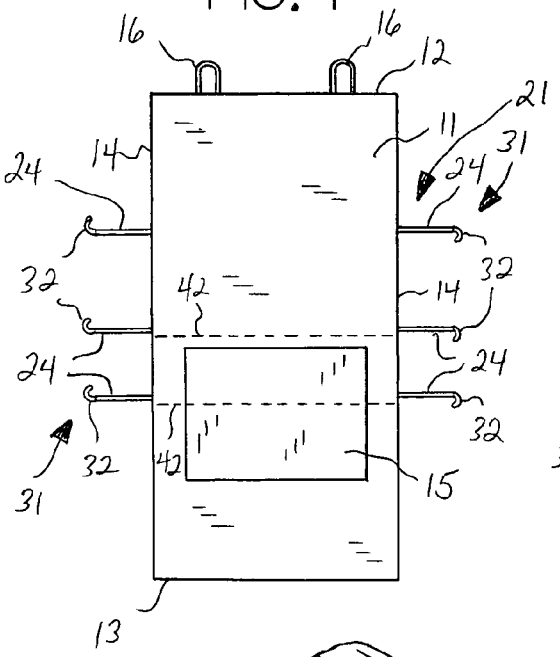
FIG. 5
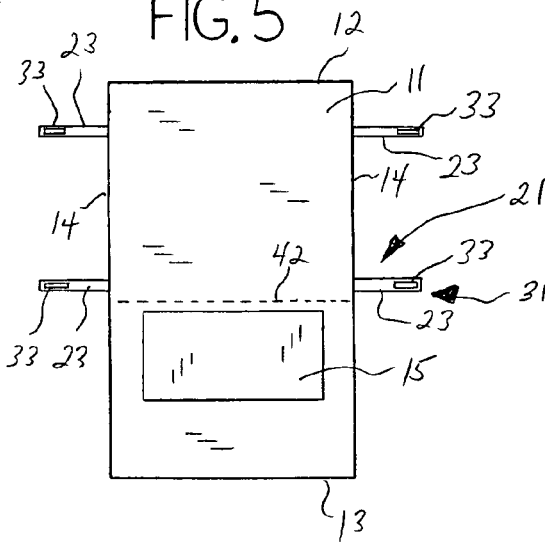
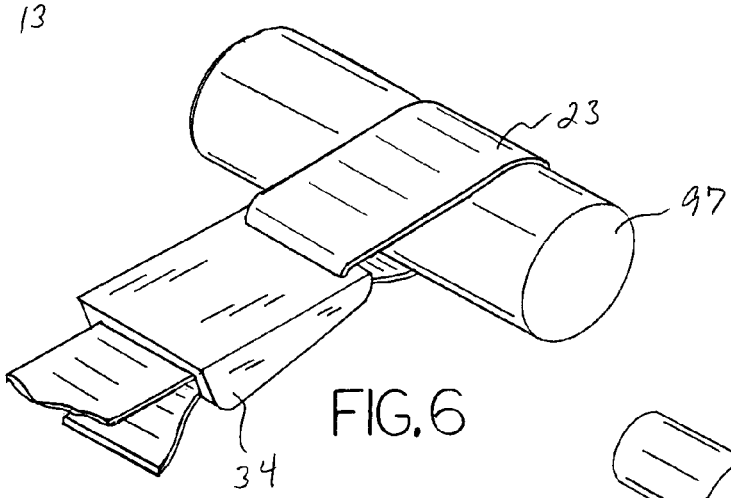
FIG. 6
FIG. 7
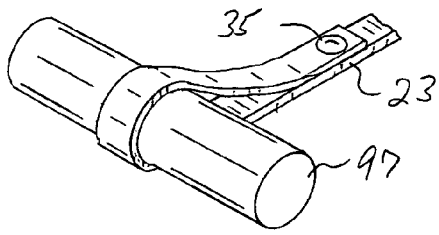

DEVICE FOR POSITIONING BEDRIDDEN INDIVIDUALS

BACKGROUND OF THE INVENTION

This invention relates generally to the field of devices used to manipulate or position bedridden patients or individuals, and in particular relates to such devices that incorporate pad or sheet members that are positioned beneath the bedridden individual, the pad or sheet member having straps or similar means for grasping the pad or sheet member as well as for securing the pad or sheet member such that the individual is in a supported position lying on his or her side.

In hospitals, nursing homes and home-care situations, patients who are seriously ill or invalids require frequent turning to prevent painful bedsores from developing on their body. In order to turn a patient on their side it is usually necessary to support the patient so the patient does not accidentally roll back. Likewise, persons who are bed-ridden for long periods of time, especially the elderly, run serious risks of pneumonia and other diseases due to inactivity and lying on their back for prolonged intervals. Nursing staffs or caregivers attempt to alleviate these problems by requiring patients to lie on their sides at least a portion of the time. Also, temporary movement of the bedridden individual is necessary to change the bed linens. Many patients, however, are too weak to roll over themselves and/or to maintain a position of rest on their sides. Nurses or caregivers must therefore manually roll the patient from the supine position to a side position and wedge pillows behind the patient's back in order to prop the patient up in the desired side supported position. With larger patients, this may require the services of at least two nurses or attendants. Moreover, the frequency of requisite movement and the need for two or more nurses or attendants to adjust the patient's position relegates many patients to institutional care rather than home care, even though their condition might otherwise be such that the loving care of family in familial surroundings would be economically and psychologically preferable for all concerned. In addition, since the patient is disposed in a bed, moving the patient places a large strain on the back of the caregiver, which often leads to injury.

Devices for manipulating or positioning bedridden patients have been developed to address these problems. Examples of such devices are shown in U.S. Pat. No. 6,073,279 to Skaler, in U.S. Pat. No. 4,908,889 to Lonardo, in U.S. Pat. No. 4,872,226 to Lonardo, in U.S. Pat. No. 4,675,925 to Littleton, in U.S. Pat. No. 4,536,903 to Parker, in U.S. Pat. No. 4,180,879 to Mann, in U.S. Pat. No. 3,884,225 to Witter, and in U.S. Pat. No. 3,458,878 to Combs. These devices are either straps or sheet members that are positioned beneath the patient, with the straps, sheet members or straps attached to the sheet members extending laterally. The straps or sheet members on one side of the patient can then by grasped by the caregiver such that the patient can be rolled laterally to one side of the bed or the other as required by pulling the strap or sheet member across the top of the patient. The straps can be temporarily connected to the bedrails to maintain the rolled position of the patient.

It is an object of this invention to provide an improved device for positioning a bedridden individual that addresses the problems set forth above and which solves additional problems as well. It is an object to provide such a device that comprises a pad or sheet member, such that the individual is more comfortably supported. It is an object to provide such a device that comprises handles or similar grasping means on the upper portion of the pad or support member, such that shifting the individual toward the head of the bed is more easily accomplished. It is an object to provide such a device wherein turning members attached to the lateral edges of the pad or sheet member extend fully across the pad or sheet member to preclude tearing of the pad or sheet member when under stress. It is an object to provide such a device where at least one portion of the pad or sheet member is easily removed from the remainder of the pad or sheet member. It is an object to provide such a device comprising body cushioning means and/or an absorbent member. It is an object to provide such a device that is disposable. Objects in addition to those set forth above, which may be achieved in combination or alone, will be apparent after review of the following disclosure.

SUMMARY OF THE INVENTION

In general, the device for positioning a bedridden patient comprises a pad or sheet member having a top or head end, a bottom or foot end, sides, turning means comprising straps, ties, elastic cords or the like affixed laterally at the sides of the pad or sheet member, securing means to temporarily fasten the pad or sheet member to the bedrails or other structural features on a bed, wherein bottom end of the pad or sheet member is easily separable from the remainder of the pad or sheet member, and separation means such as a laterally transverse weakened area or perforated line being provided to enable such separation. Preferably, multiple separation means are provided such that plural portions of the pad or sheet member can be separated.

The pad or sheet member is preferably waterproof or provided with a waterproof base layer. The pad or sheet member is preferably composed of a cushioning material, such as for example a cloth, a polymer foam, a material containing trapped bubbles of air, or the like. The turning means may comprise fabric ties, straps, elastic cords, or the like, and the fastener means may comprise knots, buckles, hook-and-loop fasteners, snaps or the like. Preferably, one or more handles are affixed at the top end of the pad or sheet member. An absorbent member comprising an added layer of cloth and/or absorbent gel material may be affixed on or incorporated within the pad or sheet member in the removable portions.

BRIEF DESCRIPTION OF THE DRAWINGS

FIG. 4 is an illustration of an embodiment of the device comprising two separation means, wherein the turning means comprise elastic members and fastening means comprise hooks.

FIG. 5 is an illustration of an embodiment of the device comprising a single separation means, wherein the turning means comprise straps and the fastening means comprise mechanical fastening means, namely hook-and-loop fasteners.

FIG. 6 is an illustration of an embodiment of the device wherein the fastening means comprises a buckle mechanism.

FIG. 7 is an illustration of an embodiment of the device wherein the fastening means comprises a snap mechanism.

DETAILED DESCRIPTION OF THE INVENTION

With reference to the drawings, the invention will now be described in detail with regard for the best mode and the preferred embodiment. In a most general sense, the invention is a device for manipulating or positioning a bedridden individual or patient in a manner that allows the individual to be rolled laterally onto one side or another by a single caregiver and held in that position.

Figure 1:
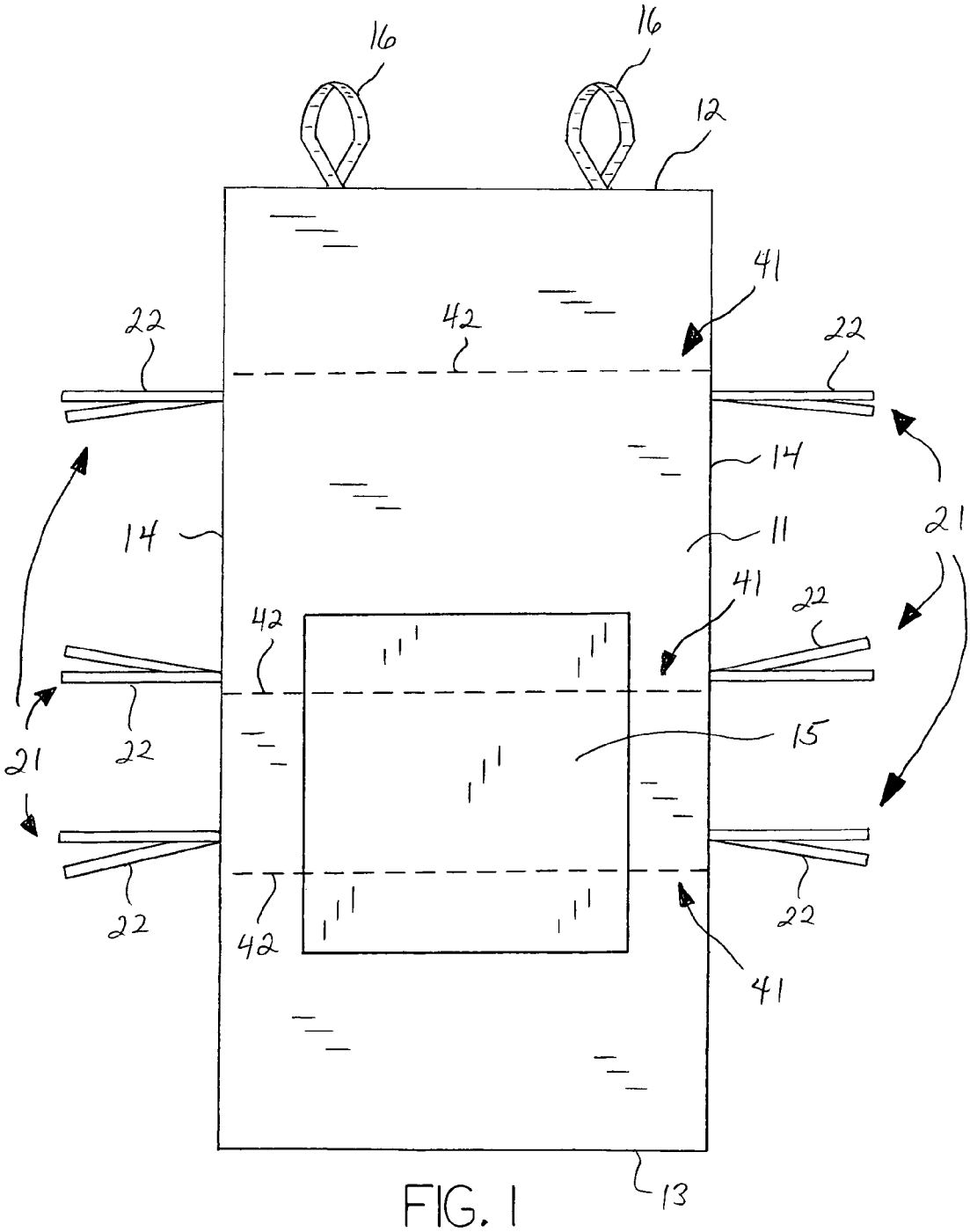
FIG. 1 is an illustration of an embodiment of the device comprising three separation means, turning means comprising paired tie members, top end handles and an absorbent member.
Figure 3:
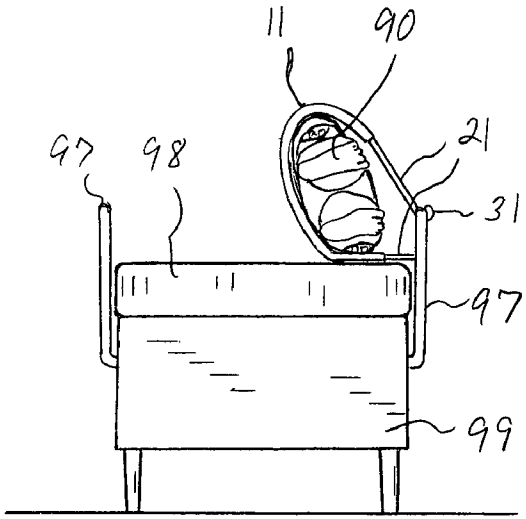
FIG. 3 illustrates the device of FIGS. 1 and 2 in the active position, the turning means being affixed to the bedrail to maintain the individual in the shifted position.
Figure 2:
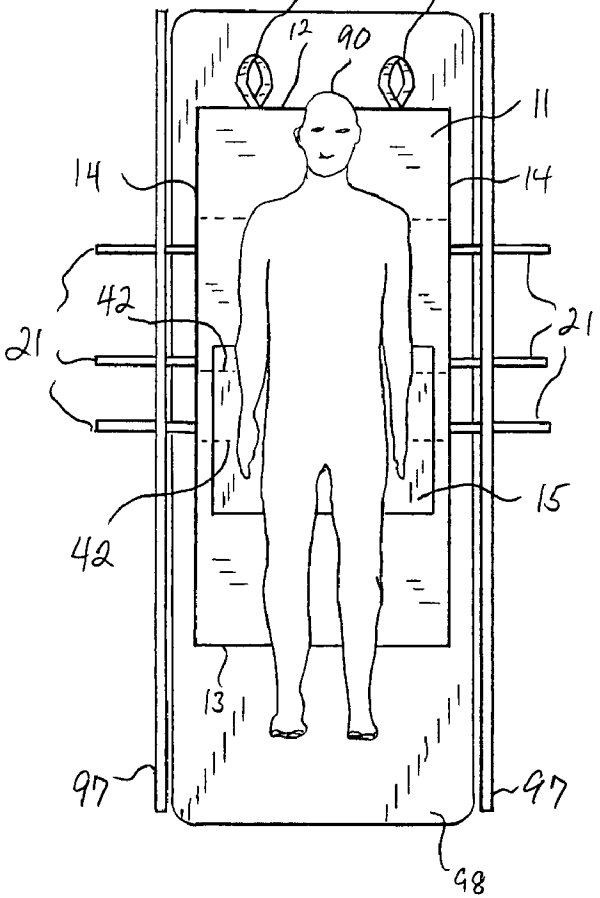
FIG. 2 illustrates the embodiment of FIG. 1 in use with a bedridden individual, the device being in the passive position.

As shown best in FIGS. 1 through 3, the device comprises a pad or sheet member 11, the pad member 11 having a thin, generally rectangular configuration with a top or head end 12, a removable bottom or foot end 13 and a pair of opposing lateral sides 14. The pad member 11 may be composed of many materials, such as for example woven or non-woven cloth, polymers or the like. The pad member 11 is preferably water repellant on at least one side, with the repellency being provided for example by the material of composition, by absorbed or adsorbed chemical or polymer compositions, by an additional underlayer attached to the pad member 11, or like means known in the art. The pad member 11 may be provided with additional cushioning properties, such as for example by providing a thickened construction, by forming the pad member 11 from a polymer foam material or a material with air encased in bubbles, by adding an additional cushioning layer, or like means known in the art. When the pad member 11 incorporates encased air bubbles, the cushioning properties of the pad member 11 in specific locations can be reduced by pricking particular bubbles to release the air. The dimensions of the pad member 11 may vary, but preferably a pad member 11 is sized and chosen for use such that the lateral dimension or width is approximately one foot less than the width of the bed 99 and mattress 98 on which it is to be used. The length of the pad member 11 may be chosen to cover the majority of the bed mattress 98 or a lesser amount, such that the pad member 11 lies under only a portion of the bedridden individual 90. The pad member 11 may be composed of a material having absorbent properties, or a separate absorbent member 15 may be provided. Absorbent member 15 may comprise a material affixed or positioned on the upper surface of the pad member 11, the material having absorbent properties or containing an absorbent gel or similar material. Alternatively, the absorbent member 15 may be incorporated within the pad member 11.

Turning means 21 are affixed to the sides 14 of the pad member 11 at multiple locations, the turning means 21 being means for grasping and pulling a side 14 of the pad member 11 across the body of the bedridden individual 90 such that the individual 90 is rolled onto his or her side, as shown in FIG. 3. Turning means 21 are arranged in at least two opposing sets and may comprise for example single or paired tie members 22 as shown in FIG. 1, straps 23 as shown in FIGS. 5, 6 and 7, elastic members 24 as shown in FIG. 4, or similar members that allow the pad member 11 to be pulled laterally. The turning means 21 may be attached at or near the sides 14 of the pad member 11, or may extend fully across the pad member 11 for added reinforcement during the rolling operation. The turning means 21 may be provided with securing means 31 for temporarily fastening the turning means 21 to the bedrail 97 or alternative structural members of the bed 99, either in the passive position as shown in FIG. 2 or in the active position as shown in FIG. 3. Securing means 31 may comprise for example hook members 32 as shown in FIG. 4, hook-and-loop fasteners 33 as shown in FIG. 5, buckle members 34 as shown in FIG. 6, snap members as shown in FIG. 7, or similar members that provide a means for temporarily securing the turning means 21 and pad member 11 to the bedrail 97 or similar structural member. Where the turning means 21 comprise tie members 22, the tie members 22 themselves act as securing means 31 as they may be temporarily knotted around the bedrail 97.

The pad member 11 further comprises separation means 41 that extend laterally and across sides 14. Separation means 41 are means for easily separating and removing portions of the pad member 11, in particular at least the bottom end 13 portion of the pad member 11, to leave a remainder portion without having to remove the entire pad member 11 from underneath the bedridden individual 90. Removal of a portion of the pad member 11, and in particular the portion at the bottom end 13, is desirable for circumstances where part of the pad member 11 becomes soiled, wet, contaminated or the like. The separation means 41 comprises a weakened section or line, such as perforations 42 shown in the Figures. The presence of the perforations allows the soiled portion to be removed from the remainder of the pad member 11 by tearing. In the embodiment shown in FIG. 5, a single line of perforations 42 with an absorbent member 15 is positioned toward the bottom end 13, such that the absorbent member 15 is adapted to be positioned below the hips of the bedridden individual 90. If the pad member 11 is soiled due to incontinence for example, the absorbent member 15 will absorb the liquids and the lower portion of the pad member 11 may be removed for disposal, the remaining portion of the pad member 11 being unsoiled and therefore left in place to use in positioning the individual 90.

In the embodiment shown in FIG. 4, separation means 41 consisting of two perforation lines 42 are utilized, and the absorbent member 15 extends above the lower perforations 42. In this configuration the absorbent member 15 will be positioned from the waist downward. A normal soiling can be addressed by removing the lower portion of the pad member 11, the perforations 42 being present in the absorbent member 15 as well as in the pad member 11. For excessive soiling, the portion of the pad member 11 below the upper perforations 42 containing the entire absorbent member 15 is removed and discarded. In the embodiment shown in FIG. 1, the separation means 41 consists of three sets of perforations 42, the third set being positioned toward the top end 12 of the pad member 11. This set of perforations 42 allows the upper portion of the pad member 11 to be separated from the remainder of the pad member 11, as may be desired if the bedridden individual vomits or if the pad member 11 becomes wet from shampooing the hair.

The location of the turning means 21 relative to the separation means 41 is important, since the functionality of the device requires at least a pair of turning means 21 on each side 14 of the pad member 11. In the embodiment as shown in FIG. 5 having two sets of turning means 21 each comprising straps 22 and hook-and-loop fasteners 33, one set is positioned so as to be under the shoulders of the bedridden individual 90, and the other set is positioned so as to be under the hips. In the embodiments shown in FIGS. 1 and 4 having three sets of turning means 21, the upper set is positioned so as to be under the shoulders of the bedridden individual 90, the middle set is positioned to be under the waist and the lower set is positioned so as to be under the hips.

Furthermore, the lowermost turning means 21 must be situated above the lowermost separation means 41, such that when the lower portion of the pad member 11 is removed from the remainder of the pad member 11, the lowermost set of turning means 21 are not also removed and remain to be utilized in rolling the bedridden individual 90. Where a middle set of turning means 21 is present in the embodiment with a second separation means 41 located below the waist of the bedridden individual 90, as seen in FIGS. 1 and 4, this middle set must be located above the second separation means 41, since the lowermost set of turning means 21 will be removed when both lower portions of the pad member 11 are removed. Even after removal, two sets of turning means 21 will remain. Likewise, if a third separation means 41 is located toward the top end 12 of the pad member 11, as shown in FIG. 1, the uppermost set of turning means 21 must be located below the uppermost separation means 41 so that they remain attached to the remainder of the pad member 11 when the top end 12 is removed.

Because it is often desirable to pull the bedridden individual 90 towards the top end 12 of the bed 99, one or more handle members 16 may be provided on the top end 12 of the pad member 11. This is especially useful where the bed 99 is set up to slope from top to bottom, as there is a tendency for the individual 90 to slide downward over time. For the embodiments shown in FIGS. 1 and 2 where there is an upper perforation line 42 near the shoulders, the handle members 16 should extend down and be attached to the middle or lower portions of the pad member 11, preferably directly to the turning means 22 that extend across the pad member 11. With this construction, pulling on the handle members 16 to shift the individual 90 upward will not cause separation of the upper perforations 42.

To use the device, the proper size pad member 11 is chosen and placed onto the bed mattress 98 beneath the bedridden individual 90. The turning means 21 and securing means 41 may be attached to the bedrails 97 to prevent the pad member 11 from shifting. To turn the bedridden individual 11 onto his or her side, the caregiver releases the turning means 21 on one side of the bed 99 and lays them across the individual 90, then goes to the opposite side of the bed 99 and grasps two of the released turning means 21. If an additional caregiver is present and three sets of turning means 21 are used, all three of the turning means 21 on the opposing side 14 may be grasped. The caregiver then pulls the turning means 21 toward the near side 14 such that the bedridden individual 90 is rolled onto his or her side, as shown in FIG. 3. The turning means 21 are then affixed to the near bedrail 97, either by tying or utilizing the securing means 31. When desired, the securing means 31 are released and the individual 90 is allowed to roll back into the passive position or any position in between. The operation is performed in the same manner on the opposite side of the bed 99 when it is desired to roll the individual 90 onto his or her opposite side.

An added benefit of the device is that with any of the embodiments shown, one separated portion of the pad member 11 will always have two sets of turning means 21 attached thereto. This allows this separated portion to be used independently to support an arm of leg of the individual 90, or to raise a portion of the individual's body, by connecting the turning means 21 to the upper bed rails 97, either across the bed 99 or on the same side.

It is understood that equivalents and substitutions to elements set forth descriptively above may be obvious to those skilled in the art, and therefore the true scope and definition of the invention is to be as set forth in the following claims.

I claim:

1. A bedridden individual positioning device comprising;

a pad member having a top end, sides and a removable bottom end, said pad member adapted to be positioned beneath a bedridden individual to protect a bed, said bed having bedrails;

at least two opposing sets of turning means affixed to said pad member for grasping and pulling a side of said pad member in order to position said bedridden individual;

separation means positioned on said pad member for separating at least the entire bottom end of said pad member and leaving a remainder portion of said pad member without having to remove the entire pad member from beneath said bedridden individual; and an absorbent member positioned toward the bottom end, the absorbent member remaining on and unattached to the pad member after the bottom end is separated via the separation means.

2. The device of claim 1, further comprising securing means connected to said turning means for temporarily fastening said turning means to said bedrails.

3. The device of claim 2, wherein said securing means are chosen from the group of securing means consisting of hook members, hook-and-loop fasteners, buckle members and snap members.

4. The device of claim 1, wherein said turning means are chosen from the group of turning means consisting of tie members, straps and elastic members.

5. The device of claim 1, comprising at least three opposing sets of turning means.

6. The device of claim 1, wherein said at least two opposing sets of turning means are affixed to said remainder portion of said pad member.

7. The device of claim 1, wherein said device comprises at least two separation means.

8. The device of claim 1, wherein said device comprises three separation means.

9. The device of claim 1, wherein said separation means comprise perforations.

10. The device of claim 1, further comprising handle members affixed to said top end of said pad member.

11. A bedridden individual positioning device comprising;

a pad member having a top end, sides and a removable bottom end, said pad member adapted to be positioned beneath a bedridden individual to protect a bed, said bed having bedrails;

at least two opposing sets of turning means for grasping and pulling a side of said pad member in order to position said bedridden individual;

securing means connected to said turning means for temporarily fastening said turning means to said bedrails; and separation means positioned on said pad member for separating at least the entire bottom end of said pad member and leaving a remainder portion of said pad member without having to remove the entire pad member from beneath said bedridden individual; and wherein said at least two opposing sets of turning means are affixed to said remainder portion of said pad member, such that they remain affixed when said bottom end is separated and removed from said remainder portion of said pad member; and an absorbent member positioned toward the bottom end, the absorbent member remaining on and unattached to the pad member after the bottom end is separated via the separation means.

12. The device of claim 11, wherein said securing means are chosen from the group of securing means consisting of hook members, hook-and-loop fasteners, buckle members and snap members.

13. The device of claim 11, wherein said turning means are chosen from the group of turning means consisting of tie members, straps and elastic members.

14. The device of claim 11, comprising at least three opposing sets of turning means.

15. The device of claim 11, wherein said device comprises at least two separation means.

16. The device of claim 11, wherein said separation means comprise perforations.

17. The device of claim 11, further comprising handle members affixed to said top end of said pad member.

18. A bedridden individual positioning device comprising;

a pad member having a top end, sides and a removable bottom end, said pad member adapted to be positioned beneath a bedridden individual to protect a bed, said bed having bedrails;

at least two opposing sets of turning means for grasping and pulling a side of said pad member in order to position said bedridden individual, wherein said turning means are chosen from the group of turning means consisting of tie members, straps and elastic members;

securing means connected to said turning means for temporarily fastening said turning means to said bedrails, wherein said securing means are chosen from the group of securing means consisting of hook members, hook-and-loop fasteners, buckle members and snap members; and separation means positioned on said pad member for separating at least the entire bottom end of said pad member and leaving a remainder portion of said pad member without having to remove the entire pad member from beneath said bedridden individual, wherein said separation means comprise perforations; and wherein said at least two opposing sets of turning means are affixed to said remainder portion of said pad member, such that they remain affixed when said bottom end is separated and removed from said remainder portion of said pad member; and an absorbent member positioned toward the bottom end, the absorbent member remaining on and unattached to the pad member after the bottom end is separated via the separation means.

* * * * *